United States Patent [19]

Jundt et al.

[11] 4,328,782

[45] May 11, 1982

[54] IGNITION SYSTEM FOR INTERNAL COMBUSTION ENGINES

[75] Inventors: Werner Jundt, Ludwigsburg; Herman Roozenbeek, Schwieberdingen, both of Fed. Rep. of Germany

[73] Assignee: Robert Bosch GmbH, Stuttgart, Fed. Rep. of Germany

[21] Appl. No.: 56,963

[22] Filed: Jul. 12, 1979

[30] Foreign Application Priority Data

Jul. 29, 1978 [DE] Fed. Rep. of Germany ..... 2833333

[51] Int. Cl.[3] ..... F02P 3/04

[52] U.S. Cl. ..... 123/609; 123/651

[58] Field of Search ..... 123/148 E; 315/209 T

[56] References Cited

U.S. PATENT DOCUMENTS

| | | | |
|---|---|---|---|
| Re. 29,862 | 12/1978 | Roozenbeek et al. | 123/148 E |
| 3,937,193 | 2/1976 | Kim | 123/427 |
| 4,124,009 | 11/1978 | Hill et al. | 123/148 E |
| 4,204,508 | 5/1980 | Jundt et al. | 123/609 |

FOREIGN PATENT DOCUMENTS

| | | | |
|---|---|---|---|
| 2428217 | 8/1975 | Fed. Rep. of Germany | 123/148 E |
| 2449610 | 4/1976 | Fed. Rep. of Germany . | |

*Primary Examiner*—Charles J. Myhre
*Assistant Examiner*—Andrew M. Dolinar
*Attorney, Agent, or Firm*—Frishauf, Holtz, Goodman & Woodward

[57] ABSTRACT

In order to reduce the amount of ignition energy supplied to an ignition coil during low speed operation of the engine, an electronic circuit is provided to regulate the open time of the ignition circuit to be constant in an upper engine speed domain and to then obey a predetermined characteristic in the mid-range. The mid-range control is gradually made ineffective at lower engine speeds where the open ignition interval is determined by speed as measured by the duty cycle of the engine ignition transducer. The change of characteristics is obtained with the aid of a control voltage source which generates a speed dependent control voltage causing the discharge time of a capacitor to be extended at low engine speeds and causing the termination of the open time of the ignition to be determined by the transducer output signal.

4 Claims, 2 Drawing Figures

IGNITION SYSTEM FOR INTERNAL COMBUSTION ENGINES

FIELD OF THE INVENTION

The invention relates to the electrical ignition of internal combustion engines. More particularly, the invention relates to the control of ignition timing and the duration of electrical current supplied to the ignition coil and the spark plugs of the engine.

BACKGROUND OF THE INVENTION

In a known ignition system for an internal combustion engine, the period of time in each ignition cycle during which the primary coil circuit is open can be maintained constant in the upper speed domain. Furthermore, the known system permits the ignition closure angle to be adaptable to the median speed domain by proper choice of the dimensions of the components. However, the known system has the disadvantage that the predetermined ignition timing characteristics lead to excessive primary circuit closure times in the region of engine idling, these times being greater than required for storing the necessary ignition energy so that energy losses result at low engine speed.

OBJECT AND SUMMARY OF THE INVENTION

It is thus a principal object of the present invention to provide an improved ignition system for internal combustion engines which so controls the engine ignition timing that the energy losses are reduced with respect to the prior art particularly in the engine idling speed range, but also generally at other speeds.

Briefly, according to the invention an ignition system is provided in which the primary circuit of the ignition coil includes a transistor operating as a constant current source whose base is connected to a speed dependent control source so that the output current is reduced for diminishing engine speeds.

The system of the invention has the advantage that the ignition circuit closure times in the upper, middle and lower engine speed domains are such that the required ignition energy is stored and yet the power losses are kept to a minimum, all with the use of relatively simple equipment.

Preferably, the source of control voltage for the constant current source is a capacitor which is discharged entirely at the time of occurrence of the ignition signal and which is recharged during the opening time of the ignition circuit.

THE DRAWING

FIG. 1 is a schematic circuit diagram of an ignition system according to the invention; and FIG. 2 is a set of timing diagrams illustrating the voltage occurring at various points of the circuit of FIG. 1.

DESCRIPTION OF THE PREFERRED EMBODIMENT

Figure 1:
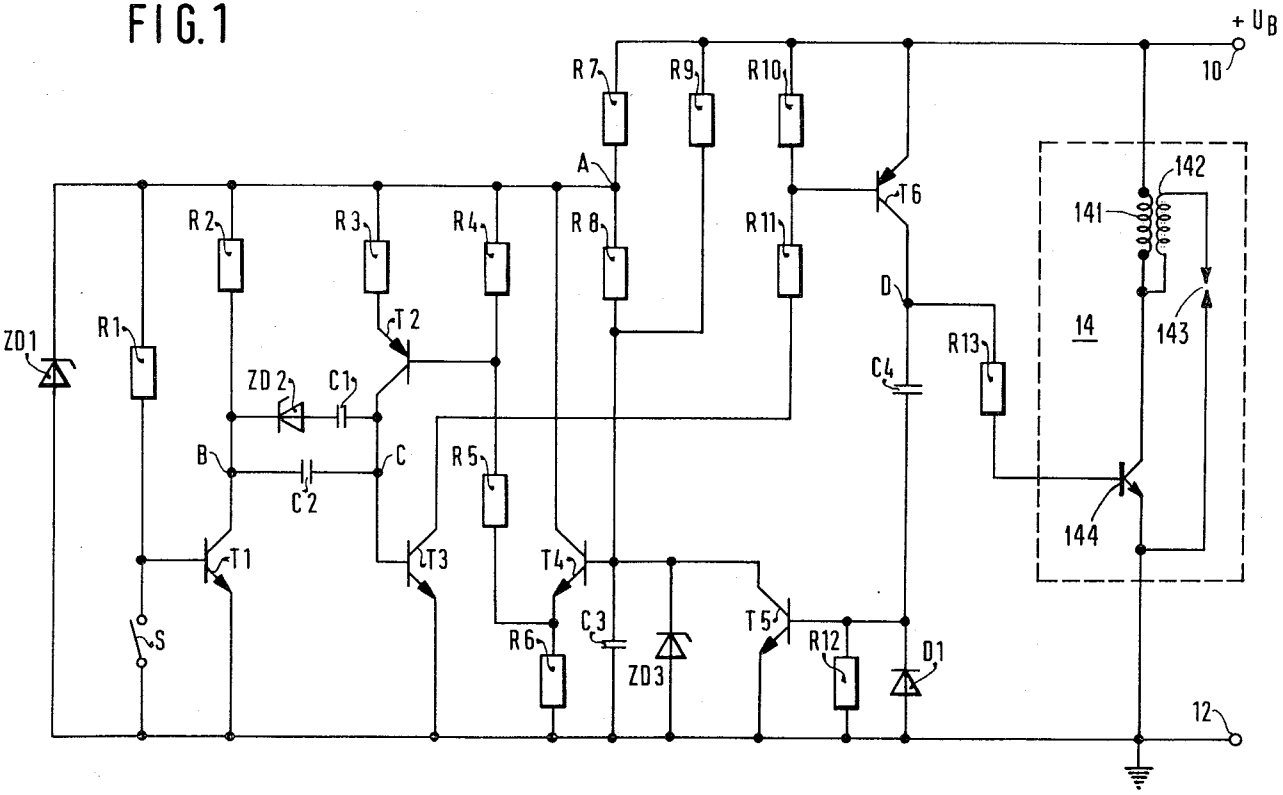

The circuit illustrated in FIG. 1 is powered by a source of direct current admitted through a positive supply line 10 and a relatively negative supply line 12 which may be identical with the vehicle ground. The contact 10 is connected through a resistor R7 with a circuit point A which is connected to ground through a voltage-stabilizing zener diode ZD1. Parallel thereto lies the series connection of a resistor R1 and a transducer shown here as a simple switch S. The junction of the resistor R1 and the switch S is connected to the base of an NPN-transistor T1 whose emitter is grounded and whose collector is connected through a resistor R2 to the circuit point A. The circuit point B, i.e., the collector of the transistor T1, is connected through a capacitor C2 with a circuit point C. This point in turn is joined to the collector of a PNP-transistor T2 and to the base of an NPN-transistor T3. The emitter of the transistor T2 is connected through a resistor R3 to the circuit point A. The emitter of the transistor T3 is grounded whereas its collector is connected to the positive supply line 10 via series resistors R10 and R11. The base of the transistor T2 is connected through a resistor R4 to the circuit point A and is grounded through the series connection of resistors R5 and R6. Transistor t2, in combination with resistors R3, R4, forms a constant current source. The collector of a further NPN-transistor T4 is connected to the circuit point A while its emitter is connected to the junction of the resistors R5 and R6. The base of the transistor T4 is joined to the circuit point A via a resistor R8 and to the positive supply source 10 via a resistor R9. The base of the resistor T4 is also grounded via a capacitor C3 in parallel with a zener diode ZD3. The emitter of a fifth transistor, an NPN-transistor T5, is grounded while its collector is joined to the base of the transistor T4 and its own base is grounded via a resistor R12 and a parallel diode D1. The base of a PNP-transistor T6 connects to the junction of resistors R10 and R11 while its emitter is coupled to the positive line 10. The collector of T6 is joined to the base of the transistor T5 via a coupling capacitor C4. The collector of the transistor T6 constitutes the circuit point D and is joined through a resistor R13 to the input of a per se known and customary output circuit 14 which also receives power from the positive battery contact 10 and the ground or reference connection 12. A capacitor C1 and in series therewith a zener diode ZD2 are further connected between the circuit points B and C. Circuit 14, as is customary, has an ignition with a primary 141, a secondary 142 connected to a spark gap 143, and a semiconductor switch, e.g. a transistor 144, serially connected with the coil primary 141.

The circuit described above and illustrated in FIG. 1 operates as follows:

If the symbolic switch S is assumed to be initially closed, i.e., if the contactless inductive transducer which it represents delivers a corresponding voltage to the base of the input transistor T1, this transistor will be blocked so that the electrode of the capacitor C2 adjacent to the circuit point B will carry the positive voltage applied to the circuit point A by the zener diode ZD1. As soon as the switch S opens, the input transistor T1 becomes conducting due to the voltage appearing at its base through the resistor R1. The voltage at the point B thus falls to near ground potential resulting in a negative voltage spike at the point C and thus also at the base of the transistor T3 which had been previously conducting and is now blocked. The blockage of the transistor T3 raises the base voltage of the transistor T6, causing it to block as well and the voltage jump generated at its collector (circuit point D) causes a blockage (non-conduction) of the output circuit 14 which initiates an ignition event.

The blockage, i.e., non-conduction of the output circuit 14, which initiates ignition, will also be referred to hereinbelow as the open time or open period of the ignition circuit.

If the function of the control voltage source consisting of the transistors T4 and T5 is momentarily left out of consideration, it will be appreciated that the transistor T2 has been held in the conducting state during the previously described processes through current obtained from resistors R4, R5 and R6. The conductive transistor T2 causes an exchange of charge in the capacitor C2, the magnitude of the current during that process being determined by the value of the resistor R3 and the base bias voltage of the transistor T2. As soon as the base voltage of the transistor T3 becomes sufficiently positive, the transistor T3 again conducts and thus also renders the transistor T6 and the output circuit 14 conducting.

This event terminates the open time of the ignition and initiates a closure time of the ignition circuit. Due to the fixed magnitude of the charge exchange current from the current source R3, R4, T2, the open time of the ignition is always constant as long as the charge exchange time of the capacitor C2 is shorter than the closure time of the switch S.

If the control voltage source consisting of the transistors T4 and T5, which was previously left out of consideration, is now placed in the circuit, it will be seen that when the transistor T6 is rendered conducting, a pulse passes via the capacitor C4 to the base of the transistor T5 which renders that transistor temporarily conducting although it is normally blocked and permits the capacitor C3 to substantially discharge completely. When the transistor T5 is again blocked, the capacitor C3 begins to recharge at a predetermined rate via the resistor R8 under the additional influence of the prevailing battery voltage $+U_B$ at the terminal 10 due to the presence of the resistor R9 in such a way that when the battery voltage is relatively low, the capacitor C3 carries a relatively lower control voltage at the end of the ignition closure time and thus reduces the subsequent ignition open period.

At the end of the closure time of the ignition, the voltage across the capacitor C3 will thus depend (a) on the duration of the closure time and thus also on the prevailing speed of the engine equipped with the ignition system and (b) on battery voltage. This control voltage across the capacitor C3 is transmitted via the emitter-follower T4 to the junction of the resistors R5 and R6 in the base circuit of the transistor T2. Accordingly, the current through the resistors R4 and R5 is reduced at low engine speeds by comparison with the previous case where no control voltage source was present and especially also because the control voltage across the capacitor C3 continues to rise during the open ignition time. As a consequence, the transistor T2 conducts relatively less and the time required to exchange the charge on the capacitor C2 until the transistor t3 is again turned on is greater than before. The degree of conduction of T2 thus depends on the charge on C3, and is speed dependent. The conductivity of T2 decreases with decreasing speed.

The net effect is that the open ignition time is extended as engine speed is reduced according to the value of the control voltage which is attained on the capacitor C3.

The time required to exchange charge on the capacitor C2 can be so long that the transistor T3 is rendered conducting only by the blockage of the transistor T1 at the occurrence of a new closure of the switch S. In that case, the duty cycle of the transducer determines the duration of the open and closed times of the ignition circuit.

In order to prevent complete blockage of the transistor T2 by the control voltage, the zener diode ZD3 connected in parallel with the capacitor C3 limits the control voltage of a predeterminable value.

A further significant feature of the invention is the presence of the series connection of the zener diode ZD2 and the capacitor C1. Their purpose is to connect the capacitor C1 in parallel with the capacitor C2 when the zener diode ZD2 breaks down, i.e., after a period of time during which only the capacitor C2 is effective in the initial phases of the charge exchange process on the capacitor C2. The increased capacitance in conjunction with the constant current through the transistor T2 results in a corresponding lowered rate of increase of the voltage.

Figure 2:
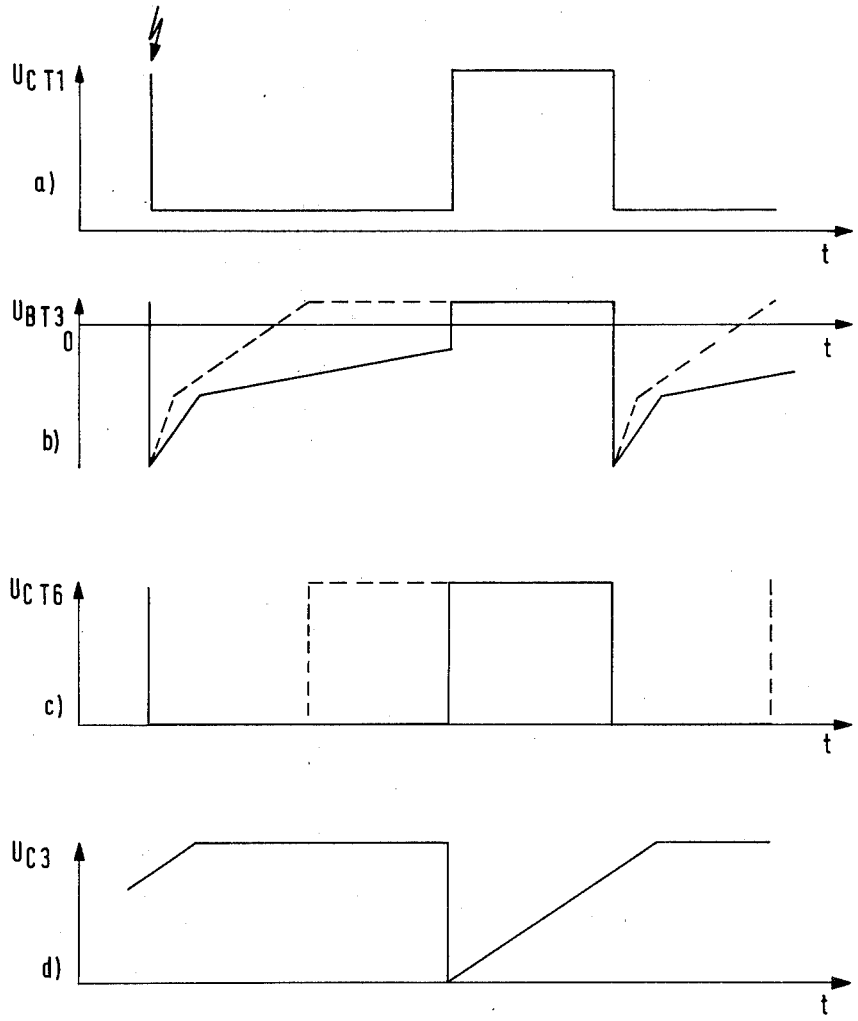

The aforementioned processes in the circuit are accompanied by changes in the potential at various points of the diagram of FIG. 1. Some of these voltages are illustrated in FIG. 2. For example FIG. 2*a* illustrates the voltage at the circuit point B, FIG. 2*b* illustrates the voltage at the circuit point c, FIG. 2*c* illustrates the voltage at the circuit point D and FIG. 2*d* illustrates the voltage at the base of the transistor T4, i.e., the control voltage, all as a function of elapsed time. The dashed curves in FIGS. 2*b* and 2*c* relate to the voltages which occur at high engine speeds so as to better illustrate the behavior of the circuit at relatively low engine speeds.

The foregoing description relates to a preferred exemplary embodiment of the invention and other variants and embodiments are possible within the scope and spirit of the invention.

We claim:

1. Ignition system for an internal combustion engine having an ignition coil having a primary (141) and a secondary (142) winding, an ignition control transistor (144), connected in series with the primary winding;

a control signal source (S, T1) providing ignition control signals;

a controlled connection circuit (C2, C1, ZD2, T3, T6) including controlled semiconductor elements (T3, T6) and a storage element (C2) connecting said control signal source to the ignition current control transistor (144) to, selectively, control conduction and blocking thereof;

a controlled charge current source (T2, R3, R4) connected to said storage element (C2) to provide a charge thereon;

circuit means (C4, T5, T4) providing a speed dependent output signal including a charge capacitor (C3) and semiconductor switching means (T5) connected to said capacitor and controlled by the control signal source to charge and discharge the charge capacitor (C3) in each ignition cycle; and a control transistor (T4) connected to said charge capacitor (C3) such that the conductivity of said control transistor changes as a function of the charge on the charge capacitor;

said control transistor (T4) being connected to control the conductivity of said charge current source (T2) so that the repetition rate of ignition cycles, reflecting speed of the engine, affects the charge on the charge capacitor (C3) and hence via the control transistor (T4) the charge current delivered by said charge current source.

2. System according to claim 1, further including a Zener diode (ZD3) connected in parallel to the charge capacitor (C3) to limit the voltage across said charge capacitor to a predetermined value.

3. Ignition system for an internal combustion engine having an ignition coil having a primary (141) and a secondary (142) winding, an ignition control transistor (144), connected in series with the primary winding;

a control signal source (S, T1) providing ignition control signals;

a controlled connection circuit (C2, C1, ZD2, T3, T6) including controlled semiconductor elements (T3, T6) and a storage element (C2) connecting said control signal source to the ignition current control transistor (144) to, selectively, control conduction and blocking thereof;

a controlled charge current source (T2, R3, R4) including a charge current supply transistor (T2) connected to said storage element (C2) as a controlled current source to provide a charge for the storage element (C2);

and circuit means (C4, T5, T4) providing a speed dependent output signal, said speed dependent output signal being connected (junction R5, R6) to control the conduction of said charge current supply transistor in a direction to increase the conductivity of an emitter-collector path thereof with increasing speed of the engine and hence affect the charge current delivered by said charge current supply transistor to said storage element (C2) as a function of engine speed;

said circuit means including a charge capacitor (C3), a control transistor (T4) connected to said charge capacitor such that the conductivity of said control transistor changes as a function of the charge on the charge capacitor, and semiconductor switching means (T5) connected to said capacitor and controlled by the control signal source to charge and discharge the charge capacitor (C3) in each ignition cycle;

the control transistor (T4) being connected to control the conductivity of the charge current supply transistor (T2), whereby the repetition rate of ignition cycles, reflecting speed of the engine, affects the charge on the charge capacitor (C3) and hence, via the control transistor (T4), controls the current delivered by said charge current supply transistor (T2) to said storage element (C2).

4. System according to claim 3, further including a Zener diode (ZD3) connected in parallel to the charge capacitor (C3) to limit the voltage across said charge capacitor to a predetermined value.

* * * * *